US005258053A

United States Patent [19]

Forwald et al.

[11] Patent Number: 5,258,053

[45] Date of Patent: Nov. 2, 1993

[54] METHOD FOR PRODUCTION OF GRANULES

[75] Inventors: Karl Forwald, Kristiansand, Norway; Rune Fossheim, Sheffield, England; Torbjorn Kjelland, Sogne, Norway

[73] Assignee: Elkem a/s, Norway

[21] Appl. No.: 909,964

[22] Filed: Jul. 7, 1992

[30] Foreign Application Priority Data

Jul. 8, 1991 [NO] Norway ..... 912653

[51] Int. Cl.[5] ..... B22F 9/00

[52] U.S. Cl. ..... 75/341; 75/335; 148/512; 148/513

[58] Field of Search ..... 148/512, 513; 75/335, 75/341

[56] References Cited

U.S. PATENT DOCUMENTS

| | | | |
|---|---|---|---|
| 3,888,956 | 6/1975 | Klint | 264/5 |
| 3,951,035 | 4/1976 | Dautzenberg et al. | 75/354 |
| 4,168,967 | 9/1979 | Sridhar et al. | 75/251 |
| 4,274,864 | 6/1981 | Bernhardt et al. | 148/513 |
| 4,294,784 | 10/1981 | Mailund | 75/341 |
| 4,473,514 | 9/1984 | Donn | 75/341 |
| 4,532,090 | 7/1985 | Dietze et al. | 264/14 |
| 4,787,935 | 11/1988 | Eylon et al. | 75/338 |
| 4,824,478 | 4/1989 | Roberts et al. | 75/341 |

FOREIGN PATENT DOCUMENTS

| | | |
|---|---|---|
| 3223821 | 12/1983 | Fed. Rep. of Germany . |
| 0439783 | 7/1985 | Sweden . |

*Primary Examiner*—Upendra Roy
*Attorney, Agent, or Firm*—Lucas & Just

[57] ABSTRACT

The present invention relates to a method for granulating a stream of molten metal which falls from a launder or the like, down into a liquid cooling bath contained in a tank. The metal stream divides into droplets in the liquid cooling bath and the droplets solidify and form solid granules. The cooling liquid has substantially uniform flow across the tank in a direction that is substantially perpendicular to the falling metal stream. The flow of cooling liquid has a velocity of less than 0.1 m/sec. The distance from the outlets of the launder to the surface of the liquid cooling bath is kept less than 100 times the diameter of the metal stream measured as the metal stream leaves the launder.

21 Claims, 1 Drawing Sheet

METHOD FOR PRODUCTION OF GRANULES

FIELD OF THE INVENTION

The present invention relates to a method for production of granules from molten metal which are formed into droplets, which droplets are cooled and solidified in a liquid cooling bath.

BACKGROUND OF THE INVENTION

From U.S. Pat. No. 3,888,956 a method is known for production of granules from a melt, especially from molten iron, in which a stream of molten iron is caused to fall against a horizontal, fixed member whereby the melt, due to its own kinetic energy, is crushed against the member and formed into irregularly sized droplets which move upwards and outwards from the member and fall down into a liquid bath of cooling medium situated below the member. While it is possible to produce metal granules using this known method, the method has a number of drawbacks and disadvantages. In particular, it is not possible to control the particle size and particle size distribution to any significant extent since the droplets which are formed when the molten metal hits the member will vary from very small droplets to rather large droplets. With production of granules from ferroalloy melts such as, for example, FeCr, FeSi and SiMn, a substantial amount of granules with a particle size below 5 mm are produced. In the production of ferrosilicon granules the amount of particles having a particle size below 5 mm is typically in the range of 22 to 35% by weight of the melt granulated and the mean particle size is about 7 mm. Ferrosilicon particles having a size below 5 mm are undesirable, and particles having a particle size below 1 mm are especially undesirable as such particles will be suspended in the liquid cooling medium and thereby necessitate continuous cleaning of the cooling medium.

From Swedish Patent No. 439783 it is known to granulate, for example, FeCr by allowing a stream of molten FeCr to fall down into a water-containing bath wherein the stream is split into granules by means of a concentrated water jet arranged immediately below the surface of the water bath. This method yields a rather high amount of small particles. In addition, the risk of explosion is increased due to the possibility of trapping water inside the molten metal droplets Due to the very turbulent conditions created by this method of granulation, the number of collisions between the formed granules will be high, which also increases the risk of explosion.

SUMMARY OF THE INVENTION

It is an object of the present invention to provide an improved method for granulation of molten metals which makes it possible to overcome the drawbacks and disadvantages of the known methods.

The present invention thus relates to a method for granulating molten metals wherein at least one continuous stream of molten metal is caused to fall from a launder or the like down into a liquid cooling bath contained in a tank, and wherein the metal stream is divided into granules which solidify characterized in that a substantially even flow of cooling liquid is caused to flow across the tank in a direction substantially perpendicular to the falling metal stream, said flow of cooling liquid having an average velocity of less than 0.1 m/sec.

According to a preferred embodiment, the flow of cooling liquid is caused to flow from one of the sidewalls of the container in a direction substantially perpendicular to the falling metal stream. Preferably, the flow of cooling liquid has an average velocity of less than 0.05 m/sec.

The flow of the of cooling liquid preferably has a vertical extension extending from the surface of the liquid cooling bath and downwards to a depth where the granules have at least an outer shell of solidified metal. The flow of cooling liquid preferably has a horizontal extension such that the flow extends on both sides of the metal stream or the metal streams According to another preferred embodiment, the vertical distance from the outlet of the launder to the surface of the liquid cooling bath is less than 100 times the diameter of the molten metal stream, measured at the point where the metal stream leaves the launder. It is more preferred to keep the said vertical distance of the metal stream between 5 and 30 times the diameter of the metal stream, and especially good results have been obtained by keeping the vertical distance of the metal stream between 10 and 20 times the diameter of the metal stream.

By keeping the above mentioned ratios between the vertical distance of the metal stream and the diameter of the metal stream within the above mentioned ranges, it is assured that the metal stream will be continuous and even as it hits the surface of the cooling liquid bath. The formation of droplets will thereby take place within the cooling liquid bath and not in the atmosphere above the cooling bath.

Water is preferably used as the cooling liquid. In order to stabilize the film of vapor which forms about the individual granules in the cooling liquid bath, it is preferred to add up to 500 ppm of tensides, such as sodium dodecylbenzene sulfonate or tetrapropylenebenzene sulfonate, to the cooling water. Tensides are a group of known surfactants. Further, from 0 to 30% of an anti-freezing agent, such as glycol or an alcohol, can preferably be added to the water. Suitable alcohols include methanol and ethanol. In order to adjust the pH value of the water, 0 to 5% NaOH is preferably added. In order to adjust the surface tension and viscosity of the water, water soluble oils may be added. The water soluble oils used as surface tension and viscosity regulating agents are cutting oils used in cutting of metals. Suitable cutting oils are sold under the trademarks BASOL and KUTWELL.

When water is used as a cooling liquid, the temperature of the water supplied to the cooling liquid tank is kept between 5° and 95° C. In granulation of ferrosilicon, it is especially preferred to supply cooling water having a temperature between 10° and 60° C., as this seems to improve the mechanical properties of the produced granules.

If it is desired to produce oxygen-free granules, it is preferred to use a liquid hydrocarbon, such as kerosene, fuel oil, silicone oil or an oil sold under the name TEXATERM, as a cooling liquid. The preferred liquid hydrocarbon is kerosene.

When the metal stream falls into the cooling liquid bath, constrictions will form on the continuous stream of molten metal due to self-induced oscillations in the stream. These oscillations cause constrictions which increase with time and finally lead to the formation of droplets. The droplets of molten metal solidify and fall further downwards to the bottom of the tank and are transported out of the tank by means of conventional devices, such as, for example, conveyors or pumps.

By having the cooling liquid flow continually at a low velocity of less than 0.1 m/sec. substantially perpendicular against the falling metal the metal stream is falling downwards in the cooling liquid bath and is divided into droplets, the flow of cooling liquid will have little or no effect on the droplet formation. The falling metal stream will, however, be continuously surrounded by "fresh" cooling liquid, causing the temperature in the cooling liquid bath in the area of the falling metal stream to reach a steady state condition. It is thus an important feature of the present invention that the dividing of the metal stream takes place via self-induced constrictions in the stream. Thus, the cooling liquid bath does not contribute to the dividing of the metal stream into droplets, but is caused to flow at a low velocity solely for cooling of the metal stream.

The method according to the present invention provides a substantially lower risk of explosion than the methods according to the prior art. The smooth conditions in the cooling liquid bath thus cause a low frequency of collisions between individual granules and thereby a reduced possibility for collapsing of the vapor layer which is formed about each of the granules during solidification.

The method according to the present invention can be used for a plurality of metals and metal alloys such as ferrosilicon with a varying silicon content, manganese, ferromanganese, silicomanganese, chromium, ferrochromium, nickel, iron, silicon and others.

Use of the method according to the present invention provides a substantial increase in the mean granule size and a substantial reduction in the percentage of granules having a particle size below 5 mm. When used for 75% ferrosilicon, the method of the present invention produces granules with a mean diameter of about 12 mm and the amount of granules having a diameter of less than 5 mm is typically 10% or less. In laboratory tests, a mean granule diameter of 17 mm has been obtained and the amount of granules having a diameter less than 5 mm has been in the range of 3–4%.

DESCRIPTION OF THE DRAWING

An embodiment of the method according to the present invention will now be further described with reference to theaaccompanying drawings wherein.

DETAILED DESCRIPTION OF THE INVENTION

Figure 1:
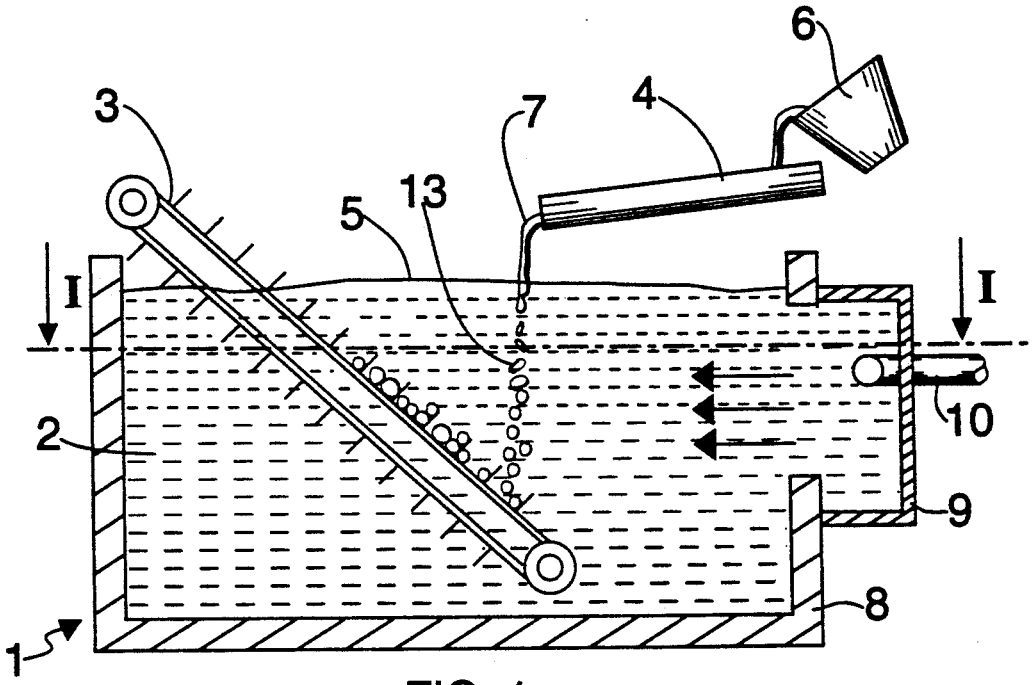
FIG. 1 shows a vertical cut trough an apparatus for granulating.
Figure 2:
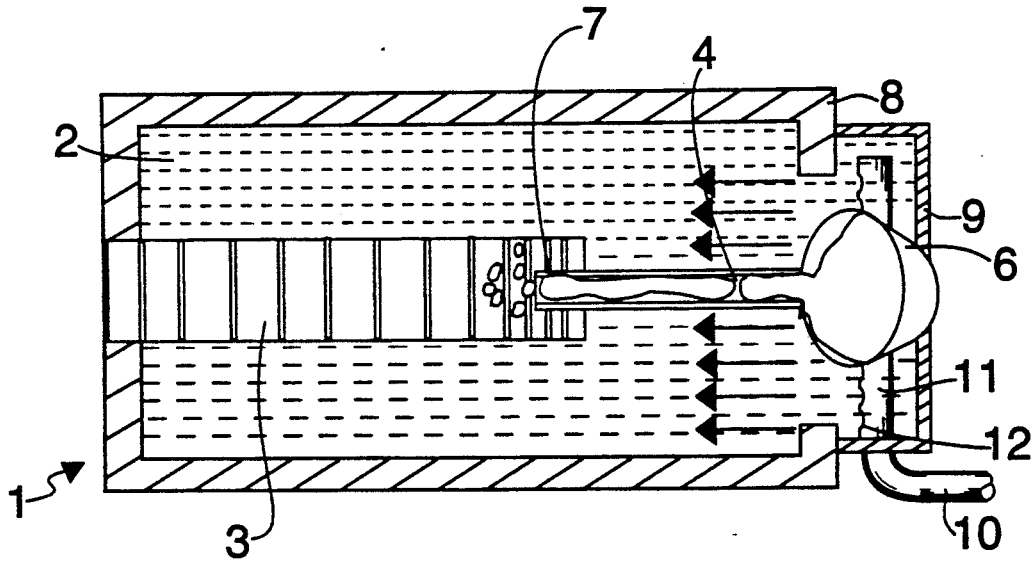
FIG. 2 shows a cut along line I—I of FIG. 1.

FIGS. 1 and 2 show a cooling liquid tank 1 filled with a liquid cooling medium 2, for example water. In tank 1 there is arranged a device in the form of a conveyor 3 for removal of solidified granules from the tank 1. A tundish 4 for molten metal is arranged at a distance above the level 5 for cooling liquid in the tank 1. Molten metal is continuously poured from a ladle 6 or the like and into the tundish 4. From the tundish 4 a continuous metal stream 7 flows through a defined opening or slit and down to the surface 5 of the cooling liquid 2 and falls downwards in the cooling liquid bath while still in the form of a continuous stream. In one of the sidewalls 8 of the tank 1 there is arranged a supply means 9 for cooling liquid. The supply means 9 has an opening facing the tank 1, said opening extending from the surface of the cooling liquid bath 2 and downards in the tank 1 to a level where the produced granules have obtained at least an outer layer of solidified metal. The opening in the supply means 9 has a horizontal extension such that the flow of cooling liquid will substantially extend beyond the spot where the metal stream hits the cooling liquid bath. Cooling liquid is continuously supplied via a supply pipe 10 to a manifold 11 arranged inside the supply means 9. The manifold 11 has a plurality of openings 12. The pressure in the supply pipe 10 is adjusted so as to form a water flow into the tank 1 having a maximum average velocity of 0.1 m/sec. The velocity of the water flow is substantially constant across the cross-section of the opening of the supply means 9 in the sidewall 8 of the tank 1. The cooling liquid flowing out of the supply means 9 is indicated by arrows in FIGS. 1 and 2.

The metal stream inside the cooling water bath 2 will thereby always be surrounded by a smooth flow of "new" water from the supply means 9. This flow of water has a velocity which is not sufficient to break up the metal stream 7 into droplets. The metal stream 7 will therefore be divided into droplets 13 due to self-induced oscillations which start when the stream 7 falls downwards in the cooling liquid bath. A regular droplet formation is thereby obtained causing formation of droplets with a substantially even particle size and only a small fraction of droplets having a particle size below 5 mm. The droplets 13 solidify while they are falling downwards in the cooling liquid bath 2 and are removed from the bath by means of the conveyor 3 or by other known means.

An amount of cooling liquid corresponding to the amount of cooling liquid supplied is removed from the tank 1 via an overflow or via pumping equipment (not shown).

These and other aspects of the invention will be more fully understood with reference to the following examples.

EXAMPLE 1

In a laboratory apparatus 75% ferrosilicon was granulated in batches of 6.5 kg molten alloy. The apparatus was as described above in connection with FIGS. 1 and 2. In all the tests, water was used as a cooling liquid. The velocity of the water flow was kept below 0.05 m/sec. for all the tests.

The test conditions and the results are shown in Table I:

TABLE I

| Test No. | L/D* | Water Temp. (°C.) | DD50** | % 5 mm |
|---|---|---|---|---|
| 1 | 15 | 8 | 17 | 8 |
| 2 | 30 | 50 | 15 | 9 |
| 3 | 70 | 90 | 15 | 10 |

*LD = Ratio between length of metal stream from the outlet of the launder to the surface of the cooling liquid bath and the diameter of the stream measured at the point where the metal stream leaves the launder.

**D50 = Mean granule size in mm

EXAMPLE 2

In an industrial plant using an apparatus as decribed in connection with FIGS. 1 and 2, batches of 75% FeSi were granulated. Each batch consisted of a minimum of 2 tons of molten alloy. Water was used as a cooling liquid in all the tests. The velocity of the water was kept between 0.01 and 0.03 m/sec.

The test conditions and the results are shown in Table II:

TABLE II

| Test No. | L/D | Water Temp. (°C.) | DD50 | % 5 mm |
|---|---|---|---|---|
| 4 | 7 | 25 | 12 | 9 |
| 5 | 15 | 15 | 11 | 10 |
| 6 | 7 | 40 | 12 | 10 |

The results show that with the method of the present invention for granulation of ferrosilicon it is possible to obtain a substantial increase in the mean granule size and to reduce the fraction of granules having a particle size less than 5 mm from 22–35% to a maximum of 10%.

EXAMPLE 3

In a laboratory apparatus silicomanganese was granulated in batches of 11 kg molten alloy. The apparatus was as described in connection with FIGS. 1 and 2.

In all the tests water containing varying amounts of glycol was used as a cooling liquid. The velocity of the water flow was kept below 0.05 m/sec. for all the tests and the temperature of the water supplied was kept at 60° C.

The test conditions and the results are shown in Table III:

TABLE III

| Test No. | L/D | % Glycol | D50 | % 5 mm |
|---|---|---|---|---|
| 1 | 13 | 10 | 11 | 4 |
| 2 | 8 | 3.4 | 10 | 6 |
| 3 | 13 | 1 | 9 | 12 |

The results show that for silicomanganese a mean granule size of about 10 mm was obtained and that the amount of granules below 5 mm was reduced with increasing amounts of glycol in the cooling water.

It will be understood that the claims are intended to cover all changes and modifications of the preferred embodiments of the invention herein chosen for the purpose illustration which do not constitute a departure from the spirit and scope of the invention.

What is claimed is:

1. In a method for granulating molten metals in which at least one continuous stream of molten metal is caused to fall from a launder down into a cooling liquid bath contained in a tank wherein the metal stream is divided into granules which solidify, the improvement comprising causing a substantially even flow of cooling liquid to flow across the tank in a direction substantially perpendicular to the falling metal stream, said flow of cooling liquid having an average velocity of less than 0.1 m/sec.

2. The method of claim 1 wherein the average velocity of the flow of cooling liquid is less than 0.05 m/sec.

3. The method of claim 1 wherein the flow of cooling liquid extends in a vertical direction from the surface of the cooling liquid bath, downwards to a depth where the granules have at least an outer shell of solidified metal.

4. The method of claim 1 wherein the flow of cooling liquid extends in a horizontal direction such that the flow extends on both sides of the metal stream or the metal streams.

5. The method of claim 1 wherein the vertical distance from the outlet of the launder to the surface of the cooling liquid bath is less than 100 times the diameter of the molten metal stream measured at the point where the metal stream leaves the launder.

6. The method of claim 1 wherein the vertical distance from the outlet of the launder to the surface of the cooling liquid is between 5 and 30 times the diameter of the metal stream, measured at the point where the metal stream leaves the launder.

7. The method of claim 1 wherein the cooling liquid is water.

8. The method of claim 1 wherein a tenside is added to the water in an amount of up to 500 ppm.

9. The method of claim 1 wherein the cooling liquid is a liquid hydrocarbon.

10. The method of claim 2 wherein the flow of cooling liquid extends in a vertical direction from the surface of the cooling liquid bath, downwards to a deph where the granules have at least an outer shell of solidified metal.

11. The method of claim 2 wherein the flow of cooling liquid extends in a horizontal direction such that the flow extends on both sides of the metal stream or the metal streams.

12. The method of claim 2 wherein the cooling liquid is water.

13. The method of claim 2 wherein the cooling liquid is a liquid hydrocarbon.

14. The method of claim 6 wherein the vertical distance from the outlet of the launder to the surface of the cooling liquid is between 10 and 20 times the diameter of the metal stream, measured at the point where the metal stream leaves the launder.

15. The method of claim 1 wherein agents are added to the water for modifying the surface tension and the viscosity.

16. The method of claim 7 wherein a freezing point reducing agent is added to the water in an amount of 0–10%.

17. The method of claim 7 wherein 0–5% NaOH is added to the water.

18. The method of claim 12 wherein agents are added to the water for modifying the surface tension and the viscosity.

19. The method of claim 12 wherein a freezing point reducing agent is added to the water in an amount of 0–10%.

20. The method of claim 14 wherein the cooling liquid is water; the cooling liquid bath has a temperature between 5° and 90° C.; tenside is added to the water in an amount of up to 500 ppm; a freezing point reducing agent is added to the water in an amount of 0–10%; sodium hydroxide is added to the water in an amount of 0–5%; and agents are added to the water for modifying the surface tension and the viscosity of the water.

21. The method of claim 20 wherein the liquid cooling bath has a temperature between 10° and 60° C.

* * * * *

UNITED STATES PATENT AND TRADEMARK OFFICE

CERTIFICATE OF CORRECTION

PATENT NO. : 5,258,053

DATED : November 2, 1993

INVENTOR(S) : Karl Forwald et al.

It is certified that error appears in the above-identified patent and that said Letters Patent is hereby corrected as shown below:

Column 2, line 5, delete "the of".

Column 3, line 5, after "metal" (first instance), insert --stream while--; line 47, change "theaaccompanying" to --the accompanying--; line 48, change "trough" to --through--.

Column 6, line 37 (claim 15), change "claim 1" to --claim 7--.

Signed and Sealed this

First Day of February, 1994

Bruce Lehman

*Attest:*

BRUCE LEHMAN

*Attesting Officer*

*Commissioner of Patents and Trademarks*